United States Patent [19]

Capozello

[11] 4,081,191

[45] Mar. 28, 1978

[54] TRUCK DOOR LOCK

[76] Inventor: Matthew Capozello, 134-28 218th St., Springfield, N.Y. 11413

[21] Appl. No.: 662,695

[22] Filed: Mar. 1, 1976

[51] Int. Cl.[2] ..... E05C 3/06

[52] U.S. Cl. ..... 292/197; 292/196; 292/DIG. 25; 296/50; 298/23 R

[58] Field of Search ..... 292/DIG. 25, 255, 196, 292/200, 195, 197; 296/50; 298/23 R, 23 A, 23 B, 23 D

[56] References Cited

U.S. PATENT DOCUMENTS

| | | | |
|---|---|---|---|
| 1,197,612 | 9/1916 | Ditlevson | 292/DIG. 25 |
| 3,000,666 | 9/1961 | Fernandes | 296/50 |
| 3,656,800 | 4/1972 | Timmons et al. | 296/50 |

FOREIGN PATENT DOCUMENTS

| | | | |
|---|---|---|---|
| 504,398 | 7/1954 | Canada | 296/50 |
| 559,303 | 2/1974 | Switzerland | 292/197 |

*Primary Examiner*—Paul R. Gilliam

*Assistant Examiner*—Kenneth J. Dorner

*Attorney, Agent, or Firm*—Steinberg & Blake

[57] ABSTRACT

A lock assembly for locking or unlocking the door of a truck or trailer body from a handle located inside the cab of the tractor. The tractor cab is fitted with a pivotable handle lever mounted on about fixed rachet gear engaged by a pivotable tooth on the handle lever, with the handle lever linked by a lock rod that extends under the floor of an attached truck or trailer body to a latch fixed on the door of the truck or trailer body. The lock rod may be fitted with coupling means for separation into a tractor section and a trailer section for use when the trailer section is detached from the tractor. The door latch is in the form of a bolt slidable axially through an eye member fixed to the truck door or alternately the bolt is bent at an angle to rotate about a fixed bracket on the door, with the bolt coupled to the lock rod by helical-slotted collar that translates reciprocal axial motion of the lock rod into rotary motion of the bolt.

1 Claim, 7 Drawing Figures

TRUCK DOOR LOCK

SUMMARY OF THE INVENTION

My invention is a lock assembly for locking or unlocking the door of a truck or trailer body from a handle located inside the cab of the tractor. The tractor cab is fitted with a pivotable handle lever mounted on about fixed rachet gear engaged by a pivotable tooth on the handle lever, with the handle lever linked by a lock rod that extends under the floor of an attached truck or trailer body to a latch fixed on the door of the truck or trailer body. The lock rod may be fitted with coupling means for separation into a tractor section and a trailer section for use when the trailer section is detached from the tractor. The door latch is in the form of a bolt slidable axially through an eye member fixed to the truck door or alternately the bolt is bent at an angle to rotate about a fixed bracket on the door, with the bolt coupled to the lock rod by helical-slotted collar that translates reciprocal axial motion of the lock rod into rotary motion of the bolt.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
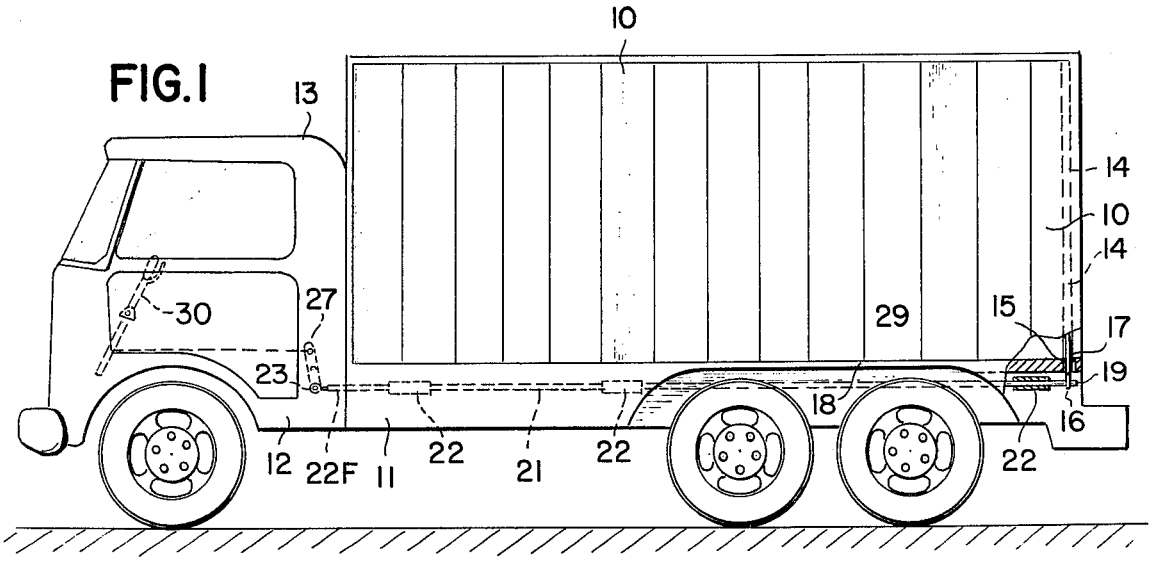
FIG. 1 is an elevation view of the invention installed on a truck body.

Turning now descriptively to the drawings, in which similar reference characters denote similar elements throughout the several views, FIG. 1 illustrates a truck body 10 permanently fixed to the frame 11 of a truck 12, with the tractor cab 13 mounted on frame 11. Truck body 10 is fitted with an articulated rear door 14 which is mounted to slide vertically in the truck body, with door 14 fitted at its lower edge 15 with a hook eye 16 that extends in the closed position of door 14 through a hole 17 in the floor 18 to project below the exterior of floor 18. A bolt pin 19 is fixed to the end of a lock rod 21 that is slidably fixed in bearings 22 in the truck frame 11 to permit axial motion of lock rod 21, with bolt pin 19, when fastened through hook eye 16, latching door 14 to prevent opening by raising of said door. Axial motion of rod 21, to withdraw bolt pin 19 from engagement with hook eye 16 releases door 14 from latching engagement.

The forward end of lock rod 21 is fitted with a female threaded collar 25 which is threadably engaged to a threaded terminal 26 pivotably joined by a pin 23 to a lever 27.

Figure 2:
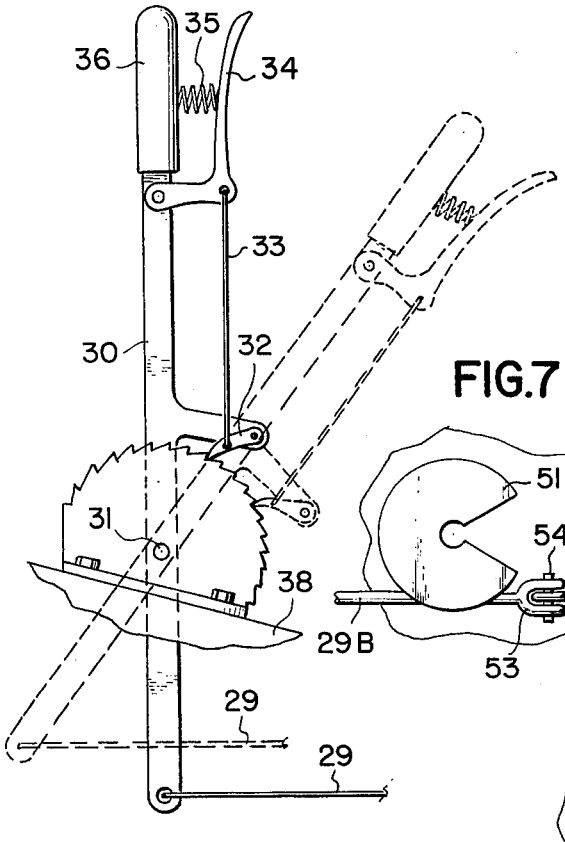
FIG. 2 is an elevation view of the operating handle.
Figure 3:
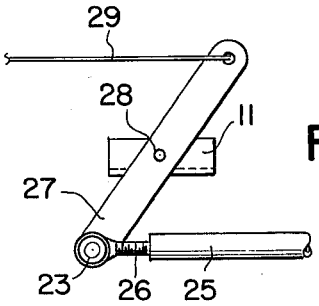
FIG. 3 is a detail view of the lock rod linkage.

As shown in FIGS. 2–3, lever 27 is pivotably fixed to frame 11 by a pin 28 with operating rod 29 pivotably fastened to the end of lever 27 opposed to the fastening pin 23 so that axial motion of operating rod 29 is in the reciprocal direction of the motion of lock rod 21. Operating rod 29 is pivotably fastened to an end of handle lever 30 that is pivotably mounted on fixed pin 31 inside of tractor cab 13. Handle lever 30 is fitted with a pivotable rachet tooth 32 controlled by rachet rod 33 fastened to pivotable grip 34, with grip 34 biased by spring 35 from the handle grip 36 of lever 30, with rachet tooth 32 mounted about the periphery of fixed rachet gear 37 fixed to the floor 38 of tractor cab 13. Manual squeezing of grip 34 towards handle grip 36 releases rachet tooth 32 from engagement with gear 37 to permit manual rotation of handle lever 30 and axial movement of rods 29 and 21 in the unlocking direction, retracting lock bolt pin 19 from engagement with door hook eye 16. Rotation of handle lever 30 in the opposite locking direction acts to extend lock pin 19, with rachet tooth 32 latching the handle lever 30 in the latched position.

Figure 5:
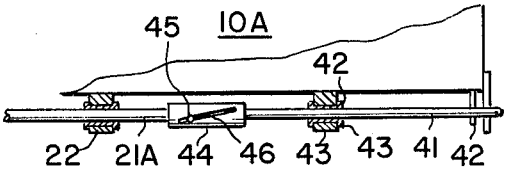
FIG. 5 is a side view of the linkage of the first alternate embodiment.
Figure 4:
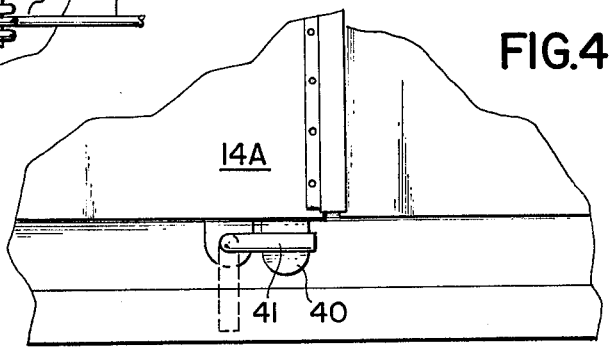
FIG. 4 is a rear view of a first alternate embodiment of the latch mechanism.

As shown in FIGS. 4–5, lock rod 21A is similarly mounted in bearings 22 under truck body 10A and linked to move, reciprocally in the axial direction with rotation of handle lever 30. Truck body 10A is fitted with doors 14A mounted on truck body 10A to rotate about hinges (not shown) on the side of doors 14A.

One or both doors 14A are fitted with a lock bracket 40 that extends below door 14A, which an L-shaped lock bolt 41 engages in the locked position shown in solid lines in FIG. 4 to prevent opening of door 14A, with lock bolt 41 rotatably mounted in bearings 42 fixed under truck body 10A. Lock bolt 41 is fitted with flanges 43 preventing axial movement of lock bolt 41 under truck body 10A.

Lock bolt 41 is joined by a collar 44 fixed to the end of lock rod 21A to convert axial movement of lock rod 21A to rotary motion of lock bolt 41. Collar 44 is formed with a helical shaped slot 45 that engages a radial detent 46 such that axial movement of lock rod 21A rotates lock bolt 41 so as to rotate lock rod 21A to either the unlocked position, shown in dash lines in FIG. 4, or the locked position, as shown in solid lines.

Figure 7:
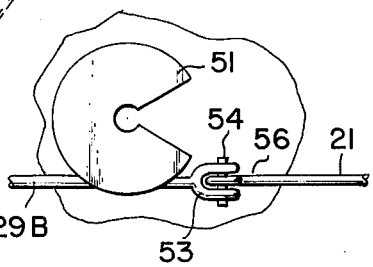
FIG. 7 is a detail plan view of the linkage of the second alternate embodiment.
Figure 6:
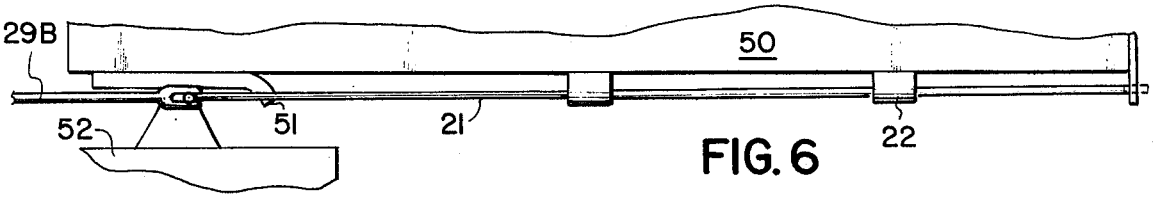
FIG. 6 is a side view of a second alternate embodiment of the invention.

FIGS. 6–7 show an alternate embodiment of the invention for use on tractor-trailer rigs in which a trailer 50 is detachably joined to the fifth wheel 51 of a tractor 52 with the tractor cab (not shown) fitted with a handle lever 30 rotatably mounted to reciprocably move, in the axial direction, an operating rod 29B that is detachably joined to the locking rod 21 of the trailer 50. Operating rod 29B is fitted with a fork coupling unit 53 that is detachably joined by a pin 54 through a hole in the forward end 56 of the lock rod 21, when the trailer 50 is attached to the tractor fifth wheel 51 so that the trailer lock rod may be controlled, in the attached condition, from the tractor cab.

Coupling unit 53 may be alternately fitted with means for automatically coupling and uncoupling from trailer lock rod 21.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A lock assembly for latching or unlatching the door of a truck body attached to a tractor, said assembly linked to a control means in the cab of the tractor and joined to a door latch means in the truck body, said control means comprising a lever pivotally mounted in the cab and pivotally linked to a first rod that extends under the truck body, said first rod slidably mounted in a bearing fixed to said truck body such that rotational movement of the lever causes axial movement of the said first rod, said door latch means comprising a lock bolt member fixed to a second rod, said second rod linked to said first rod and fixed at its exterior end to said lock bolt member, said lock bolt member extending radially to the said second rod and a bracket member fixed to a door of the truck body so as to project beyond said door in a position in which the lock bolt member in a first radial position engages the said bracket member, so as to prevent opening of said door, and in a second radial position in which the lock bolt member is clear of said bracket member, in which said second rod is linked to said first rod by coupling means that translates axial motion of the first rod into rotational movement of the second rod, in which the coupling means comprises a sleeve fixed to one of said rods and slidably mounted over the other of said rods, said sleeve formed with a through helical shaped slot which engages a detent radially fixed to the said other rod, with the second rod mounted in a bearing fixed to the truck body, said second rod having flange means that prevents axial movement but accomodates rotational movement of said second rod.

* * * * *